United States Patent [19]

Heffner et al.

[11] Patent Number: 4,544,475

[45] Date of Patent: Oct. 1, 1985

[54] ELECTROCOATING APPARATUS

[75] Inventors: Robert E. Heffner, Lower Burrell; John J. Davidson, New Kensington, both of Pa.

[73] Assignee: Aluminum Company of America, Pittsburgh, Pa.

[21] Appl. No.: 625,178

[22] Filed: Jun. 27, 1984

Related U.S. Application Data

[63] Continuation of Ser. No. 463,689, Feb. 4, 1983, abandoned.

[51] Int. Cl.[4] ..... C25D 13/14

[52] U.S. Cl. ..... 204/300 EC; 204/299 EC; 204/225; 204/269; 204/275; 204/198; 204/180.7

[58] Field of Search ..... 204/299 EC, 300 EC, 204/181 R, 181 C, 25, 26, 269, 275, 225, 257, 267, 300 R, 198

[56] References Cited

U.S. PATENT DOCUMENTS

| | | | |
|---|---|---|---|
| Re. 29,645 | 5/1978 | Kaminski | 72/405 |
| 3,231,065 | 1/1966 | Kaminski et al. | 198/656 |
| 3,476,666 | 11/1969 | Bell et al. | 204/181 R |
| 3,922,213 | 11/1975 | Smith et al. | 204/299 EC |
| 3,952,698 | 4/1976 | Beyer et al. | 118/314 |
| 4,026,311 | 5/1977 | Jackson | 134/48 |
| 4,094,760 | 6/1978 | Smith et al. | 204/181 R |
| 4,096,042 | 6/1978 | Looney et al. | 204/26 |
| 4,152,173 | 5/1979 | Jackson et al. | 134/10 |
| 4,158,405 | 6/1979 | Jackson | 198/480 |
| 4,210,507 | 7/1980 | Davidson et al. | 204/181 R |
| 4,246,088 | 1/1981 | Murphy et al. | 204/181 R |
| 4,400,251 | 8/1983 | Heffner et al. | 204/299 EC |

FOREIGN PATENT DOCUMENTS 1571808 7/1980 United Kingdom .

*Primary Examiner*—Andrew H. Metz
*Assistant Examiner*—B. J. Boggs, Jr.
*Attorney, Agent, or Firm*—David W. Brownlee; J. Stewart Brams

[57] ABSTRACT

An electrocoating apparatus for electrocoating a plurality of metal containers through coordinated cycling of a plurality of electrocoating cells, preferably in unison, through the requisite electrocoating operating cycle and including transfer means for moving the metal container to and from the respective electrocoating cells on a pass line through the apparatus.

11 Claims, 6 Drawing Figures

ELECTROCOATING APPARATUS

This is a continuation of application Ser. No. 463,689 filed Feb. 4, 1983, now abandoned.

BACKGROUND OF THE INVENTION

In the art of container coating it is well known to coat both interior and exterior surface areas of a metal can of aluminum, steel or tin plate steel, for example. Prior coating materials and methods have included the spray coating of containers with conventional paints and electrophoretic coating of containers with such coating materials as water-based or water dispersible resinous coating materials. The term "electrocoating" as used herein refers to the electrodeposition of such materials on electrically conductive surface areas of a metal can from either anodic or cathodic electrocoating material or media. The metal can is confined in a cell which is then filled with a continuous flow of coating material. A layer of particulate coating material is electro-deposited on the electrically charged metal surfaces of the can as a result of an electrical potential difference maintained between the can and oppositely charged electrodes.

The prior art includes numerous examples of electrocoating technology, among these being U.S. Pat. Nos. 3,476,667, 3,922,213, 4,094,760 and 4,210,507. Inasmuch as such electrocoating of containers insofar as discussed hereinabove and disclosed in the cited prior patents is known and further description thereof is not necessary for an understanding of the present invention, additional detailed description thereof is not included hereinafter except as may be otherwise necessary for describing the invention herein.

The known apparatus for carrying out such electrocoating processes as described and cited hereinabove often has comprised a rotary turret type machine as such machines are well known in the material handling arts both for the mass manufacture of containers and for the handling of containers in the mass processing and packaging of products such as food products. In particular, known rotary turret machines have often been employed for handling metal containers for the cleansing and coating thereof during can manufacture. For example, U.S. Pat. Nos. 3,476,666, 4,026,311, 4,158,405 and 4,246,088, and British Pat. No. 1,571,808 discloses such apparatus. U.S. Pat. Nos. 3,476,666 and 4,246,088 in particular disclose the use of rotary turret type apparatus in the processing of metal cans which includes such electrically operative treatment of the cans as electrolytic surface treatment and electrodeposition of protective coating materials thereon.

In many prior rotary turret type machines for electrocoating of containers each of the containers to be coated is carried in one of a plurality of closed cells positioned around the machine circumference at equally spaced locations on a pitch circle which is coaxial with the axis of rotation of the turret machine. Accordingly, for each such turret machine a loading station and a discharge station must be provided, as well as other ancillary container handling apparatus well known in the art.

Although prior rotary turret type machines have generally served their intended purposes, they have not been without significant shortcomings. For example, in a rotary turret machine the difficulty of providing all of the electrical and fluid connections required for electrocoating processes significantly increases the complexity of the apparatus, and therefore its cost, without any compensating benefits. Each cell of the rotary turret machine must be provided with fluid connections to supply a flow of electrocoating material to each cell, and each must be provided with fluid connections for an exhaust channel to maintain the flow of coating material during the coating cycle and to drain away residual coating material at the end of the coating cycle. Additionally, motive means such as a mechanical camming action or a fluid power means for example, must be provided to open and close each cell as required during its operating cycle. Still further, means for the impression of an electrical potential difference between the container to be coated and oppositely charged electrodes must be provided for each cell.

The individual cells in a turret type machine require phased operation according to the position of each cell about the circumference of the turret at any given time. All of the cell cycle timing and the necessary control of the electrocoating material supply and exhaust, electrical connections, cell opening and closing mechanisms, and other operative entities required in the electrocoating process must be similarly phased to provide the proper cyclic operation for each cell. This requirement necessarily results in an enormously complex rotary turret type apparatus without offering compensating benefit.

The more complex a machine is, generally the more expensive and less reliable it will be than a simpler design of comparable capability. The phased relationship of the cell operating cycles in turret machines introduces considerable complexity of mechanical design and control as the cells operate neither in unison nor in a distinct sequence of cycles, either of which alternatives could be achieved in a simpler mechanical design. In turret type machines the electrocoating cycles of the several cells overlap in real time thus creating the impression of ultra high speed production. Upon reflection, however, it will be appreciated that for all its complexity of design and abundant mechanical motion, the rotary turret electrocoating machine is basically a one-at-a-time processor which is fed a can for electrocoating thereof, cycles the can through a timed electrocoating cycle, and then discharges the can for further processing.

An additional shortcoming of rotary turret type apparatus is that each machine design is highly specialized, and such machines thus lack flexibility. Each different application thus requires a custom-designed machine.

For the above and other reasons, the rotary turret type apparatus has not proven to be entirely satisfactory, although its acceptance in the manufacture of metal cans and in the canning industry is widespread.

Other shortcomings of the prior art of electrocoating apparatus include the coordination of container and cell motion during the electrocoating cycle. Typically, the prior art has required transfer of the container on at least two axes to first position the container in coaxial alignment with the cell and then to bring the probe-nozzle portion of the cell into its operative position within the interior of the container. Thus, the prior container handling apparatus, as well as the prior electrocoating apparatus which cooperates therewith, have been of considerable complexity.

SUMMARY OF THE INVENTION

The present invention contemplates an improved apparatus for the electrocoating of metal containers which overcomes many of the above-mentioned problems. The invention includes an electrocoating apparatus in which a plurality of electrocoating cells arranged preferably in an elongated array are operable, preferably in unison, to electrocoat a corresponding plurality of containers in a single operating cycle. Accordingly, the apparatus of this invention may be fed containers from a plurality of sources of supply, one associated with each cell for example, and may discharge the coated containers to a respective plurality of discharge stations. As the cells are operable in unison, significant design simplification is achieved in the control of cell opening and closing, the supply and exhaust of coating medium, and the imposition of the requisite electrical potential difference during the electrocoating cycle. The required movement of the cells with respect to the container feed and discharge stations and with respect to the sources of electrical power and coating medium flow is limited in the preferred embodiment to up and down movement of the cell parts as required for opening and closing of the individual cells. Thus, the electrical and fluid supply conduits may be conventional, flexible conduits and need not include rotary fluid joints or rotary electrical connections of any kind.

Because the present invention offers such simplified design, it is capable of alteration by increasing or decreasing the number of electrocoating cells in the array of cells with minimal modification of the basic design. Thus, in the present invention modifications to meet differing space, layout or production requirements are readily made.

Another advantage of this invention is that the cans to be electrocoated pass therethrough preferably in a continuously inverted orientation and on a constant elevation pass line. That is, the invention requires no transfer means for moving the can axially for engagement and disengagement of the probe-nozzle therewithin.

It is therefore one object of the present invention to provide an improved container electrocoating apparatus.

A more specific object of the invention is to provide an electrocoating apparatus including a plurality of electrocoating cells operable in unison to electrocoat containers fed thereto from a respective plurality of feed stations, after which the electrocoated containers are discharged from the cells to a respective plurality of discharge stations.

Still another object of the invention is to provide an electrocoating apparatus which is operative for electrocoating of cans which pass therethrough in an inverted orientation substantially on a continuous constant elevation plane and without any significant vertical movement of the cans being required.

These and other objects and advantages of the invention will be more readily appreciated upon a reading of the following description, taken in conjunction with the accompanying drawings, in which.

DESCRIPTION OF THE PREFERRED EMBODIMENTS

Figure 1:
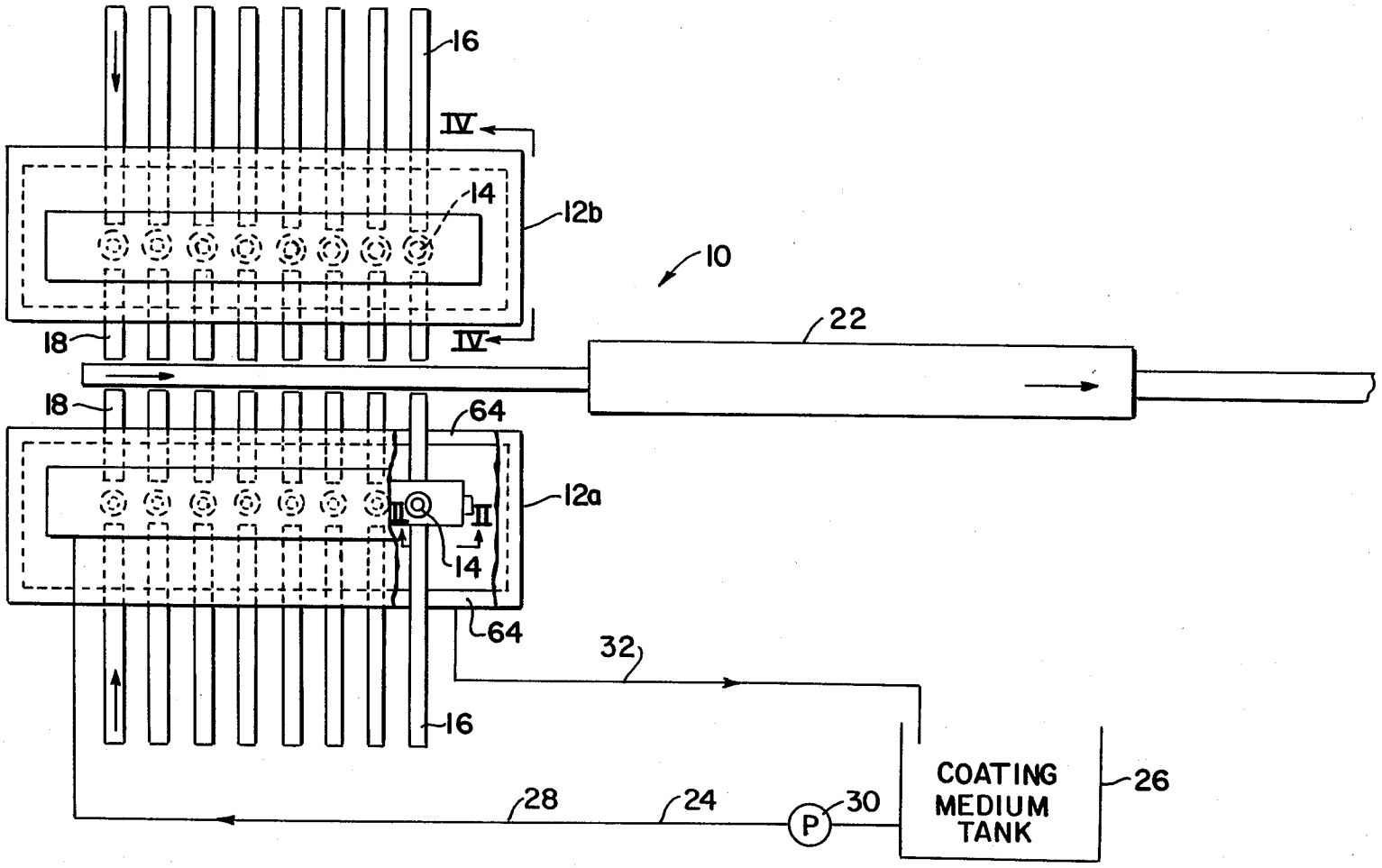
FIG. 1 is a generally schematic plan view of a portion of a container processing system including an electrocoating apparatus of the present invention.

There is generally indicated at 10 in FIG. 1 a container electrocoating system constructed according to one presently preferred embodiment of the invention and including electrocoating apparatus 12*a*, 12*b*, each having mounted thereon a plurality of electrocoating cells 14, there being 8 cells to each apparatus 12*a*, 12*b*, for example, as shown. It will be understood that either apparatus 12*a* or 12*b* may function alone in its normal manner without cooperation with the other such apparatus, and the invention therefore is not intended to be limited to a pair of mutually cooperating electrocoating apparatus. The cells 14 mounted on each apparatus 12*a*, 12*b*, preferably are arranged as an array of suitable configuration that they may be accessed by a respective plurality of infeed stations 16 and a respective plurality of discharge stations 18. An elongated, generally linear array of cells 14, as shown, may be suitable, for example.

As shown, the electrocoating apparatus 12*a*, 12*b* are arranged in conjunction with infeed stations 16 and discharge stations 18 to form a left-hand and a right-hand apparatus, each of which discharges the coated containers to a common outfeed means such as a conveyor 20 which in turn conveys the coated containers to such subsequent operations as a rinse cycle in a container rinse apparatus 22.

To provide for delivery of coating medium to each electrocoating apparatus 12*a*, 12*b* there is provided a flow loop 24 comprised of a coating medium tank 26 from which a feed conduit 28 having an in-line pump 30 extends to each apparatus 12*a*, 12*b* for delivery of coating medium thereto. A return conduit 32 directs a return flow of electrocoating medium to tank 26 for recirculation within the system. Loop 24 is shown servicing only apparatus 12*a*, it being understood that both of the electrocoating apparatus 12*a*, 12*b* require such service for operation.

Figure 2:
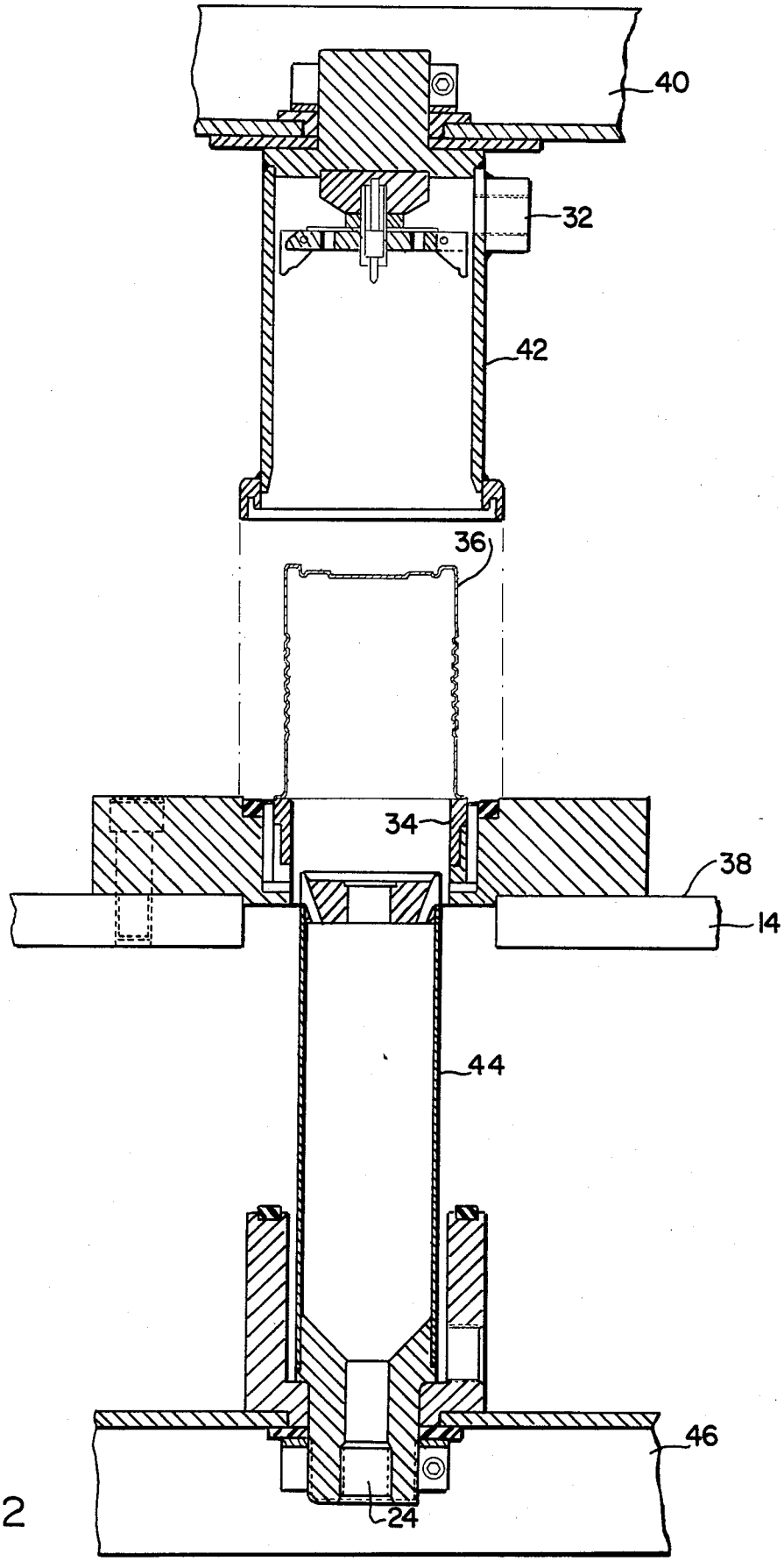
FIG. 2 is a fragmentary side elevation taken on line II—II of FIG. 1 and showing a cell of the electrocoating apparatus in the open configuration.
Figure 3:
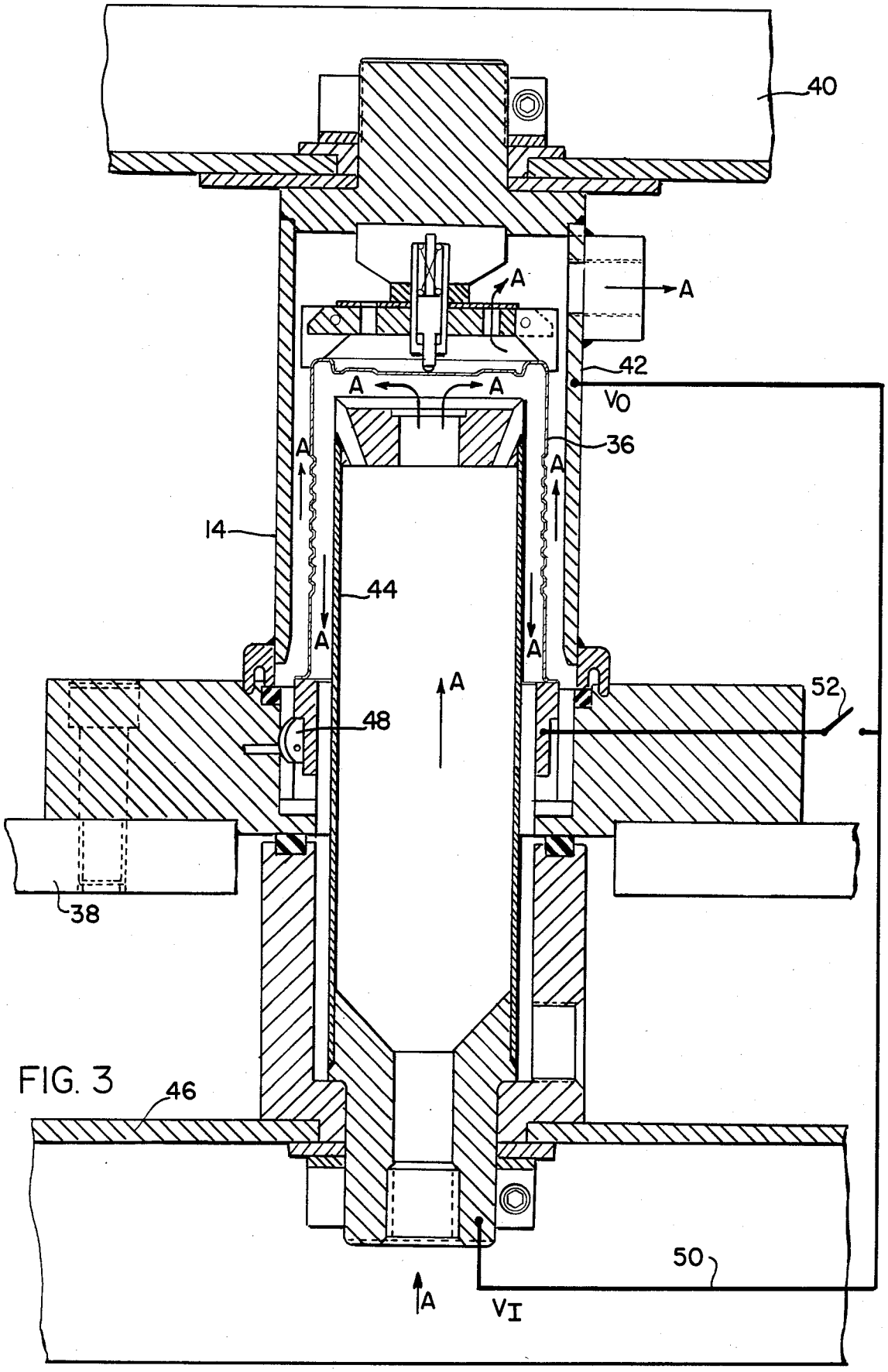
FIG. 3 is a sectional view showing a cell similar to that of FIG. 2 in the closed configuration.

Referring now to FIGS. 2 and 3, there is shown one of cells 14, respectively in an open and a closed configuration. As shown, each cell 14 includes a container receiving seat portion 34 which is adapted to move vertically as by an eccentric cam 48 (FIG. 3) or any other suitable means to register with the plane of the pass line of cans 36 along infeed 16 and discharge 18 in a manner that cans 36 are supported substantially on the above-mentioned pass line by seat portion 34 throughout the electrocoating cycle. The seat portion 34 thus receives thereon the rim of an inverted can 36 which is to be electrocoated. Seat portion 34 is carried by a central platen 38 and is located so as to cooperate in the manner described with infeed 16 and discharge 18 (FIG. 4) such that there is no requirement for a transfer means to move the cans vertically (or axially) from the plane of the pass line for coating thereof. Seat portion 34 also acts as an electrical contact which connects can 36 to one side of an electrical circuit for the electrocoating operation to be described hereinbelow.

The can to be coated is seated on seat portion 34, and maintained thereon substantially on the pass line thereof as described. A movable upper platen 40 which carries a cover portion 42 of the cell 14 is moved downward to coaxially cover can 36 while a probe-nozzle portion 44, carried by a movable lower platen 46, is moved upwardly and coaxially into the interior of can 36. Cover portion 42 and probe-nozzle 44 sealingly contact opposite sides of seat portion 34 to define a sealed cavity within which can 36 resides in the closed cell 14. The cell 14 is thus closed about can 36 to permit the engulfing thereof in electrocoating material both inside and outside of the can and an electrical potential difference is imposed between the cover 42 and probe-nozzle 44, which act as electrodes, for electrodeposition on the can of a particulate component of the coating medium.

Specifically, it will be seen that each cell 14 is disposed in the open configuration thereof as shown in FIG. 2 to receive and discharge cans 36 laterally and is disposed in the closed configuration thereof as shown in FIG. 3 for electrocoating of a can 36 by engulfing thereof in an electrocoating medium which flows through the cavity within cell 14 in which can 36 resides, flowing, for example, in the direction indicated in FIG. 3 by flow arrows A. An electrical potential difference provided by circuit 50 is then impressed between can 36 (via seat 34) and portions of probe-nozzle 44 and cover 42 as by closing of a switch 52 to provide an inside voltage $V_I$ and an outside voltage $V_O$, which may be different voltages for differential thickness electrocoating of interior and exterior portions of can 36. The coating medium thus is electrodeposited simultaneously upon interior and exterior surface portions of can 36. Upon completion of the electrocoating process the switch 52 is opened and the residual electrocoating material drained away prior to opening of the cell 14 to discharge the coated can 36 and receive another.

Figure 4:
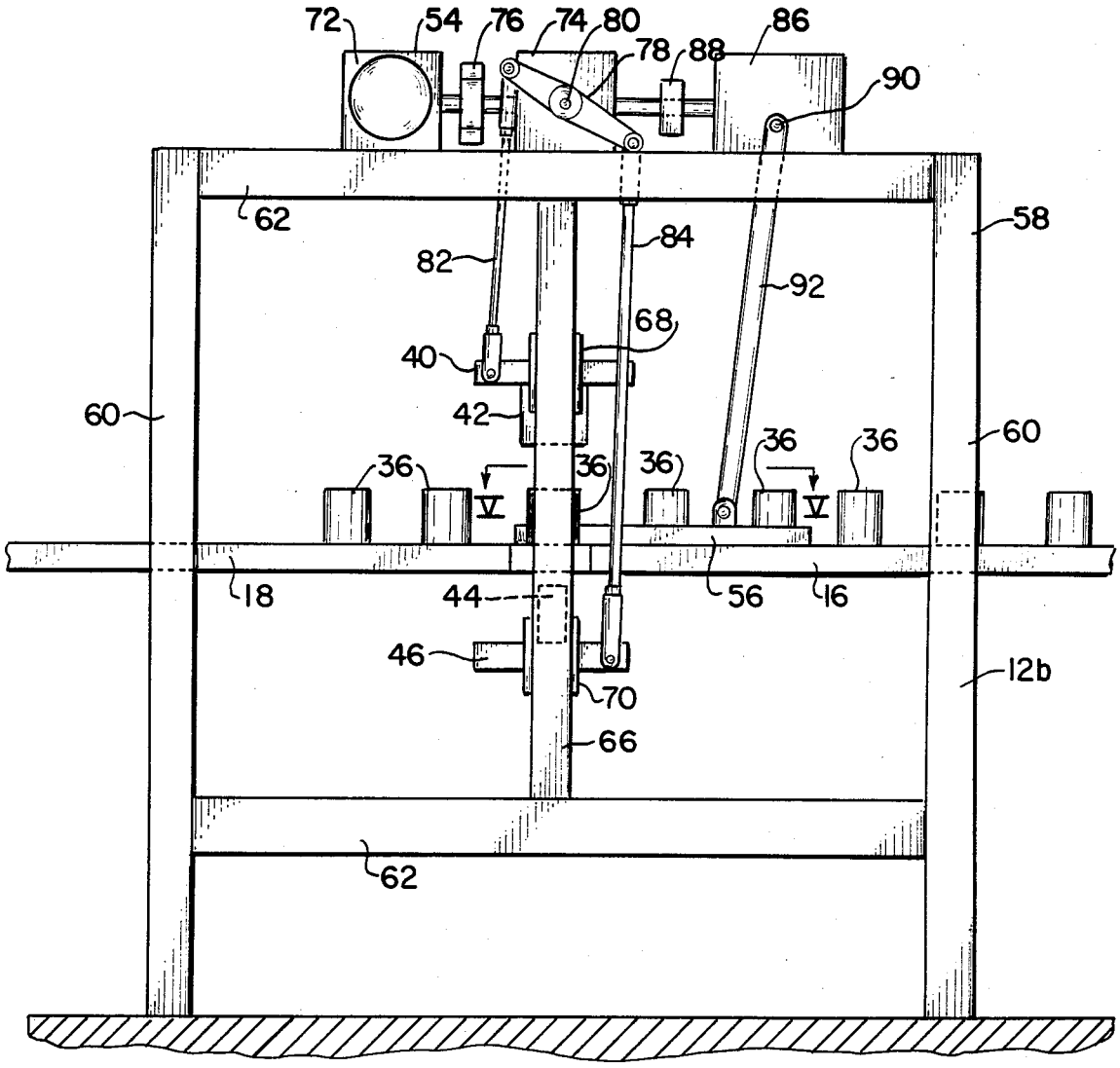
FIG. 4 is an end elevation taken on line IV—IV of FIG. 1.

Referring now to FIG. 4, in which apparatus **12*b* is depicted, it being understood that apparatus 12*a* is a mirror image thereof, the array of cells 14, preferably a linear array as shown in FIG. 1, is carried within a fabricated machine frame 58 which is constructed as a box-like structure having uprights 60 secured together by cross members 62 as by welding or other suitable means. Longitudinal members 64 (FIG. 1) run at right angles to cross members 62 and are secured to uprights 60 as by welding or other suitable means to form the box-like frame 58. Central platen 38, upper platen 40 and lower platen 46 all extend in substantially mutual parallelism along the length of frame 58. Central platen 38 carries a plurality of seat portions 34, upper platen 40 carries a cooperating plurality of cover portions 42, and lower platen 46 carries a cooperating plurality of probe-nozzle portions 44**.

To provide for simultaneous cycling of all of cells 14, the platens 40 and 46 are movable as by mechanized means 54 and are co-operable with the cam actuators 48 of seat portions 34 for cycling in unison of all of cells 14.

To provide for the ordered and uniform feeding of cans 36 along infeed 16, for positioning of cans 36 in alignment with seat portion 34, and for discharge of coated cans, a mechanized feed means 56 is provided which advances cans 36 along infeed 16 in uniform steps or increments including a final step or increment of motion into alignment with the respective seat portion 34.

Figure 5:
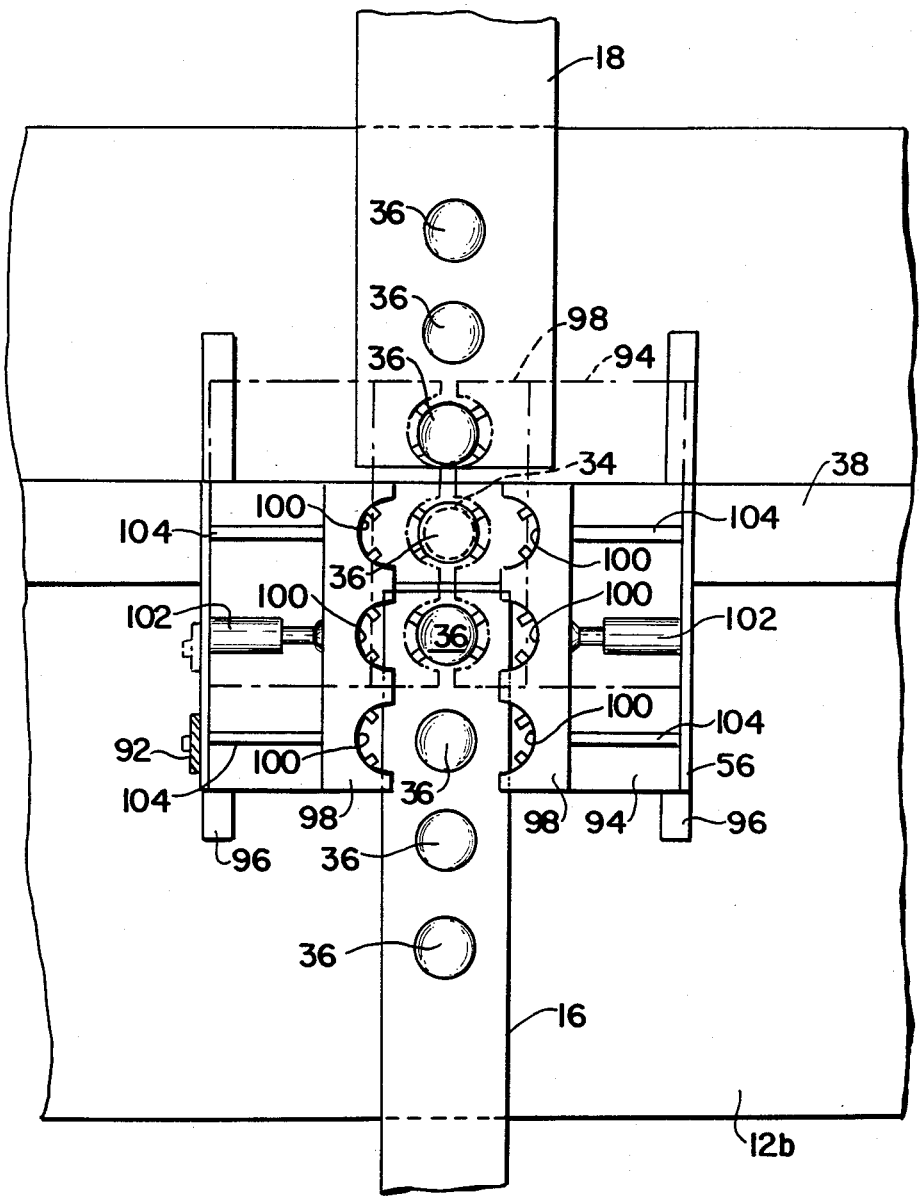
FIG. 5 is a fragmentary top plan view taken on line V—V of FIG. 4.
Figure 6:
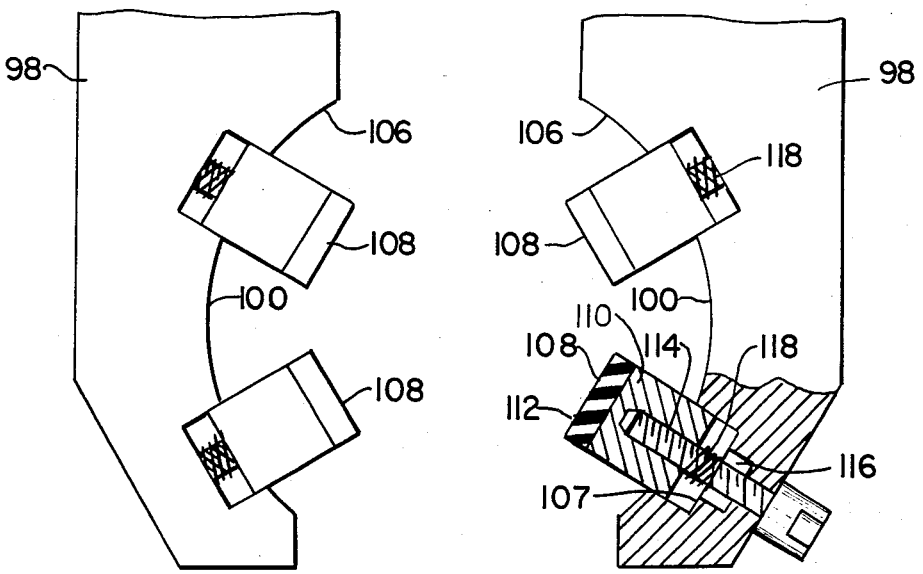
FIG. 6 is a fragmentary portion of FIG. 5.

Referring now to FIGS. 5 and 6, there is shown a portion of the apparatus **12*b* including a portion of platen 38 having a seat portion 34 thereon, an infeed 16, a corresponding discharge means 18, shown as a conveyor belt, for example, and the feed or transfer means 56. Transfer means 56 includes a carriage 94 which is movable to and fro along guides 96 between a retracted position, shown in solid line, and an advanced position, shown in phantom line, under the impetus of the mechanical connection through link 92 to mechanical oscillator 86**.

Carriage 94 carries thereon a pair of can engaging members 98 which are movable transversely of the pass line of cans 36 between an open configuration, shown in solid line, and a closed or can gripping configuration, shown in phantom line, in coordination with the to and fro movement of carriage 94. Members 98 include three cooperating pairs of can engaging jaw portions 100 spaced longitudinally thereof for gripping cans 36. Suitable actuators such as hydraulic cylinder assemblies 102 are provided to move members 98 to the open and closed positions thereof along suitable guides 104. Each can engaging jaw portion 100 includes a concavity 106 formed in the respective member 98. The concavities 106 are preferably formed generally as circular arc segments having recesses 107 (FIG. 6), each having mounted therein a radially inwardly projecting can engaging finger assembly 108 which is moved inwardly to lightly but firmly grip a can when members 98 are moved to the closed configuration. Each finger assembly 108 includes a block portion 110 having a resilient elastomer pad 112 affixed to the radially innermost surface thereof for engaging a can 36. Each block 110 is secured with respect to the respective concavity recess 107 as by means of a screw 114 passed into a stepped, radially extending bore 116 in member 98 and threadedly engaged within block 110. A coil spring 118 encompasses each screw 114 intermediate block 110 and the base of recess 107 to bias the block 110 radially inwardly and to provide a spring bias for gripping of the cans 36.

The upper and lower platens 40 and 46 are rendered movable in a predetermined path with respect to central platen 38 by engagement with generally vertically extending guide bars 66, FIG. 4, located adjacent each longitudinal end of the apparatus **12*b*. Guide bars 66 extend intermediate cross members 62 and are rigidly affixed thereto. The longitudinal ends of platens 40 and 46 include guide channels 68, 70, respectively, which cooperably engage guide bars 66 for sliding engagement thereon along the longitudinal extent of guide bars 66 toward and away from center platen 38**.

To provide for control of platen movement, the mechanical means 54 includes a motive means such as a gear motor 72 connected in power transmitting cooperation with a mechanical oscillator 74 as by a suitable belt and pulley drive arrangements 76. Oscillator 74 is provided with a crank 78 non-rotatably secured to a rotationally oscillatory shaft 80 of oscillator 74. One end of crank 78 is connected by means of an adjustable toggle link assembly 82 with upper platen 40 while the other end of crank 78 is connected by means of an adjustable toggle link assembly 84 with lower platen 46. Upon rotary oscillation of shaft 80 the ends of crank 78 move in opposite directions with respect to central platen 38 whereby oscillatory motion of shaft 80 in one rotary direction, the clockwise direction for example, causes cells 14 to open as platen 40 is moved upward from platen 38 and platen 46 is moved downward from platen 38 along guide bars 66. During oscillatory motion of shaft 80 in the opposite or counter-clockwise direction, platen 40 moves downward and platen 46 moves upward along guide bars 66 to bring portions 42 and probe-nozzle portions 44 into cooperable engagement with respective seat portions 34 to close the respective cells 14 for an electrocoating operation.

An output side of oscillator 74 is connected in power transmitting engagement with a mechanical oscillator 86 as by a belt and pulley drive arrangement 88. Oscillator 86 includes an oscillatory rotary shaft 90 to which is non-rotatably secured one end of the link 92, and the opposite end of which is pivotally connected to feed means 56 for driving the feed means 56 in oscillatory motion forward and back along infeed 16 as described hereinabove in coordination with the opening and closing of cells 14 to feed a can 36 into position for engagement thereof upon seat portion 34 each time the cells 14 are open.

From the description hereinabove, it will be appreciated that all of cells 14 in the elongated array are operable in unison and in timed coordination with all of feed means 56 of each apparatus 12*a*, 12*b* to provide for electrocoating of a plurality of containers during each complete operating cycle. Because all of the cells in each apparatus 12*a*, 12*b* operate in unison, all control functions may be arranged in parallel with respect to the plural cells 14 such that the cyclic operation of all the cells 14 combined requires only a single timed sequence of control functions. The requisite control functions include actuation of feed means 56, actuation of each seat portion 34 to engage the rim of an inverted can positioned thereover by feed means 56, retraction of feed means 56 and closing of cells 14, flooding of cells 14 with electrocoating medium, imposition of an electrical potential difference within cells 14 to carry the electrodepostion to completion, termination of the electrical potential difference, draining of residual electrocoating medium from cells 14, and opening of cells 14 to discharge the coated can and receive another.

Specifically, in the repetitive electrocoating cycle a continuous line of cans 36 is being fed in step-wise fashion by transfer means 56 through the apparatus 12*b* from infeed 16 to discharge 18. Beginning in the open, retracted position of transfer means 56 as shown in FIG. 5, the associated cell 14 is closed about the can 36 residing on seat portion 34 and that can 36 is being electrocoated. At the completion of the electrocoating cycle the cell 14 is opened by movement platens 40, 46 as described hereinabove. In coordination therewith, cylinders 102 are actuated to move members 98 transversely inwardly so that the finger assemblies 108 grip the can 36 resting on seat portion 34 as well as the next two adjacent cans 36 on infeed 16. Seat portion 34 is then retracted by actuation of cam 48 to disengage the can 36 thereon and the coordinated operation of oscillator 86 acting through link 92 advances carriage 94, and thus members 98, along guides 96 to the advanced position as shown in phantom line whereby the can 36 just electrocoated is moved onto discharge 18. Simultaneously, the next can 36 in line is advanced one step into alignment with seat portion 34, and the second in line can 36 is advanced one step to the first in line position. Cam 48 is again actuated to bring seat portion 34 into engagement with the can 36 aligned therewith, and members 98 are opened by action of cylinders 102 to disengage the cans 36 held thereby. The cell 14 closes about can 36 on seat portion 34 for electrocoating thereof and during the electrocoating cycle oscillator 86, acting through link 92, retracts carriage 94 thus positioning members 98 in the initially described position for transfer of cans 36 as above described upon completion of another electrocoating operation.

The invention hereinabove described provides for electrocoating of containers in a simplified and highly productive apparatus which combines the operation of an array of electrocoating cells in a single real time cycle rather than utilizing a slow one-at-a-time electrocoating approach and without introducing the operational complexities of overlapping real time cycles or other mechanical complexities of prior rotary turret machinery.

Inasmuch as the invention has been described hereinabove with reference to one presently preferred embodiment, various alternatives and modifications are considered to be within the scope of the invention. For example, the specific structural features of frame 58 and the operation mechanism for platens 40 and 46 and for feed means 56 may be varied within a wide design latitude according to the specific parameters of the electrocoating operation to be undertaken and the limiting parameters of its use environment including available floor space and the like. In addition, the specific guide means and supports for platens 40 and 46 and the means for mechanized actuation thereof and of feed means 56 may also be varied or supplemented extensively as by substitution of hydraulic actuators, chain drives, or any other suitable actuation means in lieu of mechanical linkages without departing from the broad spirit or scope of the invention.

These and other embodiments and modifications having been envisioned and anticipated by the inventors, the invention is intended to be construed as broadly as permitted by the scope of the claims appended hereto.

What is claimed is:

1. An apparatus for sequentially electrocoating a continuous stream of open-ended containers wherein an electrocoating medium is maintained in intimate contact with a container to be electrocoated while an electrical potential is applied to the container for electrodeposition of the electrocoating medium on surface areas thereof, said apparatus comprising:

at least one electrocoating cell;

infeed means cooperable with said at least one electrocoating cell for delivering such containers thereto for electrocoating thereof;

discharge means cooperable with said at least one electrocoating cell for receiving electrocoated containers therefrom;

said at least one electrocoating cell including a container receiving seat portion for supporting a container to be electrocoated, and further including a cover portion and a nozzle-probe portion which cooperate to enclose such a container when supported by said seat portion;

cell opening and closing means operable to move said cover and nozzle-probe portions with respect to said seat portion for opening said at least one electrocoating cell to discharge such a container and to receive another therein and for closing said at least one electrocoating cell to enclose such a received container therein;

transfer means cooperable with said at least one electrocoating cell and with said infeed and discharge means to sequentially transfer containers in such a continuous stream from said infeed means into juxtaposition with said seat portion, and to simultaneously transfer the preceding container in such stream from said seat portion to said discharge means, when said at least one electrocoating cell is open;

said transfer means including movable container engaging means which is operable to repetitively engage a plurality of adjacent containers in such a stream, advance such plurality of containers a predetermined incremental distance along a passline at a predetermined constant elevation, and disengage such plurality of containers;

said seat portion being movable transversely of said passline to respective container support and release positions in cooperation with said container engaging means to support a container juxtaposed therewith when such container is disengaged from said container engaging means;

means cooperable with said at least one electrocoating cell to deliver electrocoating medium thereinto when said at least one electrocoating cell is closed and for subsequently draining residual electrocoating medium therefrom prior to opening of said at least one electrocoating cell; and electrical means cooperable with said at least one electrocoating cell to apply such an electrical potential to a container enclosed herewithin.

2. The combination as claimed in claim 1 wherein said at least one electrocoating cell is a plurality of cells.

3. The combination as claimed in claim 2 wherein said cell opening and closing means includes first elongated platen means for carrying a plurality of said cover portions, said first platen means being selectively movable with respect to a respective plurality of said seat portions for moving said cover portions into cooperating juxtaposition with the respective said seat portions to enclose the exterior of such containers supported by the respective said seat portions.

4. The combination as claimed in claim 3 wherein said cell opening and closing means includes second elongated platen means for carrying a respective plurality of said nozzle-probe portions, said second platen means being selectively movable with respect to said respective plurality of said seat portions for moving said nozzle-probe portions into cooperating juxtaposition with the respective said seat portions to insert said nozzle-probe portions into the interiors of such containers supported by the respective said seat portions.

5. The combination as claimed in claim 4 wherein said first and second platen means are selectively movable to move said cover portions and said nozzle-probe portions, respectively, into and out of cooperating juxtaposition with the respective said seat portions to respectively close and open said plurality of cells.

6. The combination as claimed in claim 5 additionally including motive means cooperable with said first and second platen means for mutually coordinated movement thereof to open and close said plurality of cells in unison.

7. The combination as claimed in claim 6 wherein said motive means includes mechanical oscillator means and link means operatively connecting said mechanical oscillator means to said first and second platen means for said mutually coordinated movement thereof.

8. The combination as claimed in claim 7 wherein said seat portions include container engaging surface portions which are selectively positionable with respect to said transfer means to supportingly engage such a container positioned in jutaposition to said seat portion at said contant elevation.

9. The combination as claimed in claim 8 wherein each said container engaging surface portion is effective to support such a container while enclosed within the respective said cell.

10. The combination as claimed in claim 9 wherein each said container engaging surface portion is engagable with the rim of an inverted such container for support thereof while enclosed within the respective said cell.

11. The combination as claimed in claim 2 wherein said plurality of cells is a generally linear array.

* * * * *